United States Patent [19]

Yamakoshi et al.

[11] 4,046,600

[45] Sept. 6, 1977

[54] METHOD OF PRODUCING LARGE DIAMETER STEEL RODS

[75] Inventors: Noboru Yamakoshi, Kobe; Tsugio Kaneda, Akashi; Nobuyasu Hatsuoka, Gogatsuka; Shinichi Shimazu; Tatsu Fujita, both of Kobe; Yoshiro Yamada, Akashi; Tetsuo Yamada; Atsuo Mizuta, both of Kobe, all of Japan

[73] Assignee: Kobe Steel Ltd., Kobe, Japan

[21] Appl. No.: 533,508

[22] Filed: Dec. 17, 1974

[30] Foreign Application Priority Data

Dec. 17, 1973 Japan ..... 48-141691
Dec. 17, 1973 Japan ..... 48-141692

[51] Int. Cl.[2] ..... C21D 7/14

[52] U.S. Cl. ..... 148/12.4; 148/12 B; 148/36

[58] Field of Search ..... 148/12 B, 12.3, 12.4, 148/14, 134, 143, 156, 36

[56] References Cited

U.S. PATENT DOCUMENTS

| | | | |
|---|---|---|---|
| 3,231,432 | 1/1966 | McLean et al. | 148/12 B |
| 3,532,560 | 10/1970 | Tomioko et al. | 148/12.4 |
| 3,647,571 | 3/1972 | Okamoto et al. | 148/12.3 |
| 3,666,572 | 5/1972 | Nakagawa et al. | 148/134 |
| 3,668,020 | 6/1972 | Lucht | 148/12 B |
| 3,844,848 | 10/1974 | Stacey | 148/12 B |

OTHER PUBLICATIONS

Kobe Steel Co. Technical Bulletin, Effects of Alloy Elements on Mechanical Properties of 0.8% C Steel, Hirano et al., pp. 1–34.

Iron and Steel (Japan), 1971, Properties of Wires Heat Treated Directly, by Utilizing Heat Conductivity of Boiling Water, Naruo et al., 3 pages.

Iron and Steel (Japan), 1973, Various Properties of Steel Wires Cooled in Boiling Water, Takeo et al., 4 pages.

Wire Journal, Yamakoshi et al., vol. 5 No. 10, Oct. 1972 pp. 36–46.

*Primary Examiner*—Arthur J. Steiner

*Attorney, Agent, or Firm*—Oblon, Fisher, Spivak, McClelland & Maier

[57] ABSTRACT

A large gauge high strength steel rod having a diameter of not less than 9 mm, is produced from high carbon steel containing, by weight percent, from 0.65 to 0.90% carbon and from 0.15 to 1.5% chromium capable of being drawn without subsequent heat treatment.

1 Claim, 6 Drawing Figures

FIG. 3 PRELIMINARY TEST IN SP LINE

FIG. 4 PRELIMINARY TEST IN SM LINE

METHOD OF PRODUCING LARGE DIAMETER STEEL RODS

BACKGROUND OF THE INVENTION

1. Field of the Invention

This invention relates to a steel rod having a diameter of not less than 9 mm and a tensile strength of above 115 kg/mm$^2$, and more particularly to a high strength steel rod which is produced from a high carbon steel which contains by weight percent, from 0.15 to 1.5 chromium. This rod can be drawn without subjecting it to a re-heat treatment.

2. Description of the Prior Art

Over about the past ten years, studies have been made to develop a process for producing steel rods by controlled cooling treatment. According to this method, the steel rod is hot rolled, and then the cooling rate is adjusted so as to complete phase transformation before the rods are taken up. The result is a structure which essentially consists of fine pearlite. The rod thus produced provides consistent and superior mechanical properties and results in a reduction in the amounts of scale produced, as compared to rods which have been taken up immediately after hot rolling. As a result, it is possible to draw steel rods to a final gauge without subjecting them to a re-heating treatment, i.e., patenting treatment.

However, at the present time, the controlled cooling technique provides satisfactory results only in the production of rods of relatively smaller gauge, say, on the order of 5 mm in diameter. A technique has not heretofore been disclosed for the production of steel rods of a larger gauge.

Heretofore, various types of controlled cooling apparatus have been used in practice. Although they vary in their cooling capabilities depending on their type, the basic principle which they incorporate is the same. In all of these, a fine pearlite structure having a small volume fraction of proeutectic-phase is obtained by adjustment or by control of the cooling conditions for the steel rod immediately after hot rolling. In other words, if the cooling rate is excessively higher than the desired cooling rate, bainite and martensite structures will result. On the other hand, if the cooling rate is lower than the aforesaid desired rate, then a large fraction of proeutectic ferrite and coarse pearlite results. A steel rod thus super-cooled or slow-cooled has very poor drawability. Accordingly, it is imperative that the rod be subjected to a re-heat treatment before subsequent drawing. Various attempts have been proposed in an attempt to provide cooling media and arrangement for cooling zones for optimum cooling in order to obtain a rod characterized by excellent drawability and mechanical properties in various controlled cooling apparatus. However, those controlled cooling apparatus suffer from the shortcomings of having limitations on adjustment or control of cooling rate. This is particularly critical for the slow cooling rates necessary for rods having large diameter. The result of failure to achieve the proper adjustment in slow cooling rate is a steel rod of rather poor tensile strength. On the other hand, if an excessive cooling rate occurs, then a large difference in temperature results between the surface portion and the inner portion of a rod, so that the surface portion is excessively cooled and transforms into a martensite structure. This greatly reduces ductility and toughness.

Many attempts have been proposed for improving the controlled cooling technique to obtain a high quality, large gauge steel rod. For instance, "Kobe Steel Company Technical Bulletin," Vol. 21, No. 2, p. 83, reveals that the addition of alloying elements such as chromium, tungsten or the like are effective in achieving high tensile strength and toughness for large guage steel rods after the controlled cooling treatment. This also suggests that these alloy additions might be effective in the case of controlled cooling after hot rolling. In addition, in "TETSU TO HAGANE" (Iron and Steel), Vol. 57, No. 4 (1971), p. 120, it is disclosed that a tensile strength as high as 120 kg/mm$^2$ could be obtained for a large gauge steel rod (for instance 14.3 mm in diameter) from direct heat treatment (ED treatment) using boiling water as a cooling medium. However, as has been recently reported in "Iron and Steel", Vol. 59, No. 11 (1973), the maximum tensile strength of the steel rod having a diameter of 9 mm falls in the range of from 110 to 115 kg/mm$^2$ which suggests that there are severe limitations to such attempts.

Studies have now been made on the aforesaid controlled cooling techniques for large gauge steel rods using various types of controlled cooling apparatus, generally used in production scale applications, for the purpose of providing high tensile strength large gauge steel rods which are drawable without using any reheating treatment. As a result, a surprising success has now been achieved in producing such steel rods which have diameters above 9 mm and tensile strengths of about 115 g/mm$^2$.

SUMMARY OF THE INVENTION

Accordingly, it is one object of the present invention to provide a large gauge steel rod which may be drawn without using a re-heat treatment.

It is another object of the present invention to provide a large gauge steel rod which has a tensile strength of over 115 kg/mm$^2$, and a structure consisting essentially of fine pearlite.

There and other objects of this invention, as will hereinafter become more readily apparent from the following description have been attained in the first aspect of the present invention, which provides a high strength steel rod having a gauge of over 9 mm in diameter and which is made of a high carbon steel containing, by weight percent, from 0.65 to 0.90% carbon and from 0.15 to 1.5% chromium and which is essentially a fine pearlite structure. These rods are obtained by subjecting the steel to a controlled cooling treatment by means of an air medium, after hot rolling in which a phase transformation takes place within the rod.

According to a second aspect of the present invention, there is provided a high strength, large gauge steel rod which is made of a high carbon steel containing, by weight percent, from 0.65 to 0.90% carbon and from 0.50 to 1.20% chromium and which has a structure consisting essentially of pearlite, the aforesaid rod being obtained according to a controlled cooling treatment by the use of a free-air cooling medium.

According to a third aspect of the present invention, there is provided a high strength, large gauge steel rod which is made of a high carbon steel containing, by weight percent, from 0.65 to 0.90% carbon and from 0.20 to 0.5% chromium and which has a tensile strength of over 115 kg/mm$^2$, the aforesaid rod being obtained according to a controlled cooling treatment by the use of a forced-air cooling medium, after hot rolling. This rod is drawable without further re-heat treatment.

According to a fourth aspect of the present invention, there is provided a large gauge, high strength steel rod as previously set forth, wherein said rod contains less than 2.0% silicon.

According to a fifth aspect of the present invention, there is provided a high strength, large gauge steel rod as previously set forth wherein said rod contains less than 1.5% manganese.

According to a sixth aspect of the present invention, there is provided a high strength steel rod of large gauge as previously set forth, wherein said rod contains less than 2.0% silicon and less than 1.5% manganese.

According to a seventh aspect of the present invention, there is provided a high strength, large gauge steel rod as previously set forth, wherein said rod contains at least one of aluminum, niobium, vanadium, zirconium or titanium in an amount of less than 0.3% in total.

According to an eighth aspect of the present invention, there is provided a high strength, large gauge steel rod as previously set forth wherein the diameter of the steel rod ranges from 9 to 19 mm.

According to a ninth aspect of the present invention, there is provided a high strength, large gauge steel rod as previously set forth, wherein the tensile strength of the steel rod is higher than 120 kg/mm$^2$.

According to a tenth aspect of the present invention, there is provided a high strength, large gauge steel rod as previously set forth, wherein the reduction of area obtained by tensile test is over 35%.

DETAILED DESCRIPTION OF THE PREFERRED EMBODIMENTS

The present invention is a result of studies on the effects of controlled cooling using a steel rod rolling line equipped with a controlled cooling device, such as is actually used in the production of a high carbon steel rod containing chromium.

Figure 1:
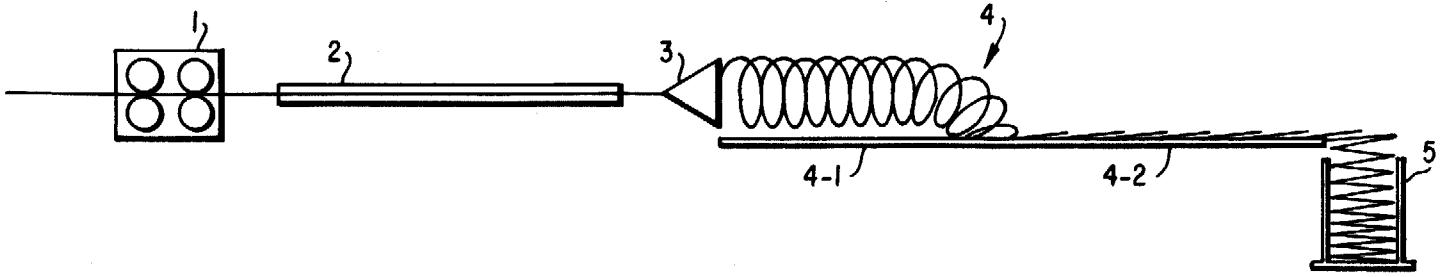
FIG. 1 is a diagrammatic view showing one example of an outline of a steel rod rolling line of the free-air cooling type.
Figure 2:
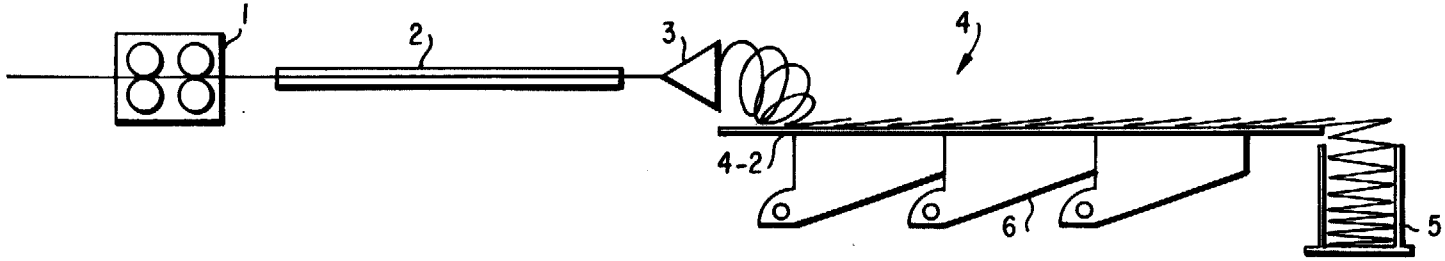
FIG. 2 is a diagrammatic view showing one example of a steel rod rolling line of a forced-air cooling type.

One of the steel rod rolling lines used, as shown in FIG. 1, consists of a rolling mill line 1, a primary water cooling zone 2, a laying device 3, a secondary cooling zone 4 composed of a vertical conveyor 4-1 adapted to transport rods in a sprial form with coil turns being erected in the vertical direction and a horizontal conveyor 4-2 adapted to transport a rod in a flat position, and a collector 5. This line will be referred to as a SP line hereinafter. Another steel rod rolling line, as shown in FIG. 2, consists of a rolling mill line 1, a primary water cooling zone 2, a laying device 3 a secondary cooling zone 4 composed of a horizontal conveyor 4-2 adapted to transport a rod with the coil turns being placed in a flat position, and a forced-air cooling device 6, and a collector device 5. This latter line will be referred to as a SM line hereinafter. In the SP line, the vertical conveyor portion 4-1 can be utilized as a horizontal conveyor line. On the other hand, in both SM and SP lines, water cooling can be completely stopped in the primary water cooling zone 2.

The mechanical properties of controlled cooled steel rods made by the use of these actual rolling lines were studied on the steels of the chemical composition shown in Table 1.

TABLE 1

| Sample No. | Chemical Compositions of Sample Steel Rod (%) | | | | | |
|---|---|---|---|---|---|---|
| | C | Si | Mn | Cr | Al | Ti |
| 1 | 0.75 | 0.25 | 0.79 | 0.03 | 0.055 | — |
| 2 | 0.78 | 0.28 | 0.81 | 0.24 | 0.040 | — |
| 3 | 0.73 | 0.29 | 1.15 | 0.50 | 0.048 | — |
| 4 | 0.78 | 0.24 | 0.74 | 0.72 | 0.047 | — |
| 5 | 0.73 | 0.26 | 0.71 | 0.92 | 0.060 | — |
| 6 | 0.77 | 0.85 | 0.75 | 0.28 | 0.032 | 0.05 |
| 7 | 0.75 | 1.00 | 1.02 | 0.25 | 0.052 | 0.03 |

Figure 3:
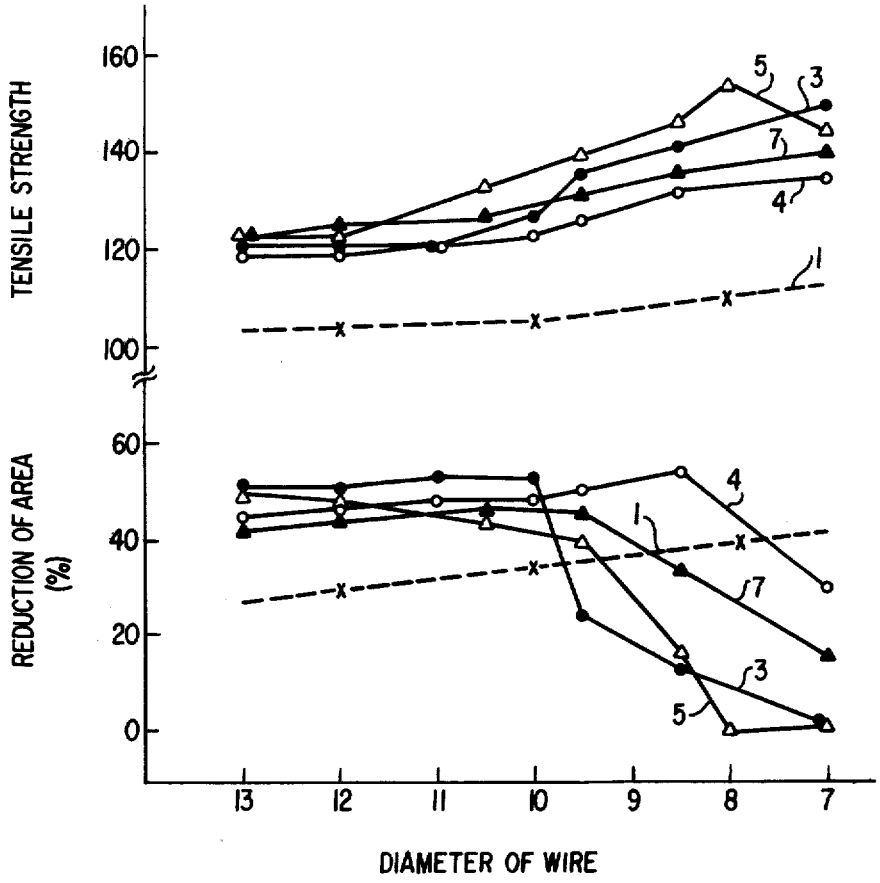
FIG. 3 is a plot showing the relationship among tensile strength, reduction of area (%) and diameter of steel rods obtained by the controlled cooling treatment of the steel rods produced by the rolling line shown in FIG. 1, after hot rolling.

Sample Nos. 1,3,4,5 and 7 shown in Table 1 were hot-rolled to various diameters and then subjected to SP type controlled cooling. FIG. 3 shows the results of measurements of tensile strength and reduction of area on those controlled cooled steel rods. As is clear from FIG. 3, the tensile strength and reduction of area of sample 1, which is an ordinary high carbon steel, decreases with an increase in the diameter of steel rod (particularly the tensile strength). The reduction in area of sample 1 is less than 105 kg/mm$^2$ and less than 35% for a steel rod having a diameter exceeding 10 mm, respectively. In contrast thereto, samples Nos. 3 to 5, which contain chromium or increased amounts of manganese give tensile strengths over 115 kg/mm$^2$, i.e., of the order of 120 kg/mm$^2$, while reduction of areas reach the order of 50% exceeding 35% in the case of a rod diameter of over 9 mm. On the other hand, in the case of a rod having a medium gauge such as represented by sample Nos. 3 to 5, the tensile strength will increase with a decrease in the diameter of the steel rod. Due to the presence of bainite or martensite, the ductility thereof suffers severe reduction. In other words, reduction in area by tensile tests characteristically deteriorates in the case of Sample No. 4 below about 7 mm diameter; for Sample No. 5, below about 8.5 mm diameter; and for Samples 3 and 7, below 9.5 mm diameter according to the Mn, Cr and Si contents. Therefore, in order to carry out any subsequent drawing operation, a re-heat step is necessary. In this manner, steel rods having a large gauge and optimum mechanical properties may be obtained by adjusting the amounts of chromium, manganese and silicon to levels commensurate with the diameter of the rod.

Figure 4:
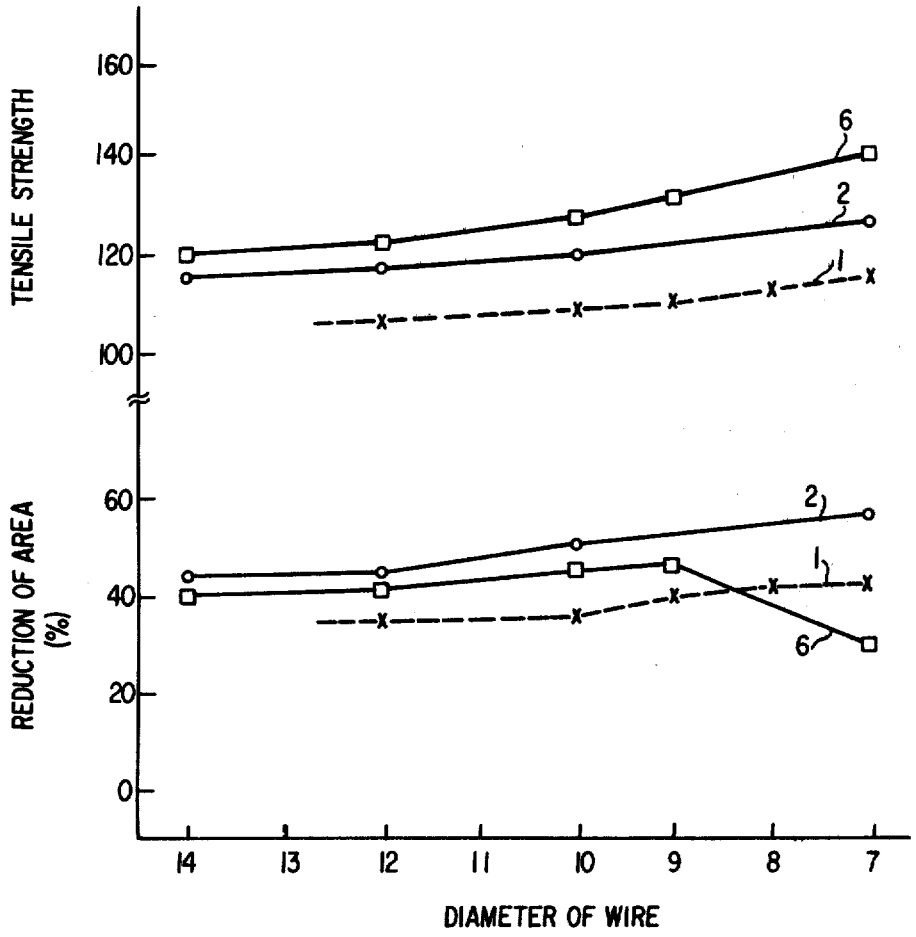
FIG. 4 is a plot showing the relationship among tensile strength, reduction of area (%) and diameter of steel rods obtained according to the controlled cooling treatment of the rods from the steel rod rolling line shown in FIG. 2 after hot rolling.

FIG. 4 shows the results of measurements of tensile strength and reduction of area of steel rods which have been obtained by subjecting the sample Nos. 1, 2 and 6 shown in Table 1 to the controlled cooling treatment after hot rolling to various diameters on the SM line. As is shown in FIG. 4, Sample No. 1 which is an ordinary high carbon steel rod, decreases in tensile strength and reduction of area, with increase in diameter of the steel rod. Particularly, the rod decreases in tensile strength to as low as 108 kg/mm² for a rod diameter of over 9 mm. This is an extremely depressed tensile strength. On the other hand, Sample Nos. 2 and 7 containing increased amounts of chromium and silicon give tensile strengths of over 115 kg/mm² with a reduction in area of over 35% for a diameter of over 9 mm. In addition, Sample No. 6 containing increased amounts of chromium and silicon produces tensile strengths of the order of 120 kg/mm² for a diameter of about 14 mm, while showing a reduction in the reduction of area for a rod diameters of about 7 mm. In this manner, steel rods having a large gauge and optimum mechanical properties may be obtained by adjusting the amounts of chromium and silicon contained therein commensurate with the diameter of a steel rod. In addition, the sample No. 2 having a diameter of over 9 mm with an excellent combination of tensile strength, ductility and toughness can be drawn into a rod without subjecting it to any heat treatment.

Figure 5:
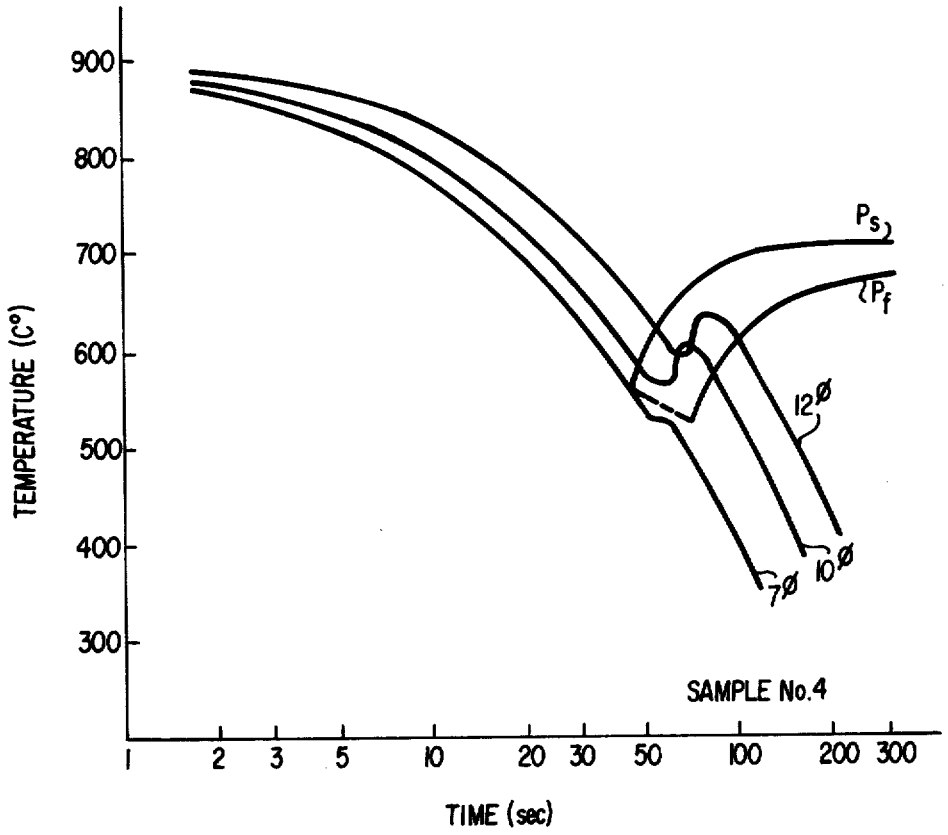
FIG. 5 is a plot showing a continuous cooling curve for sample 4 shown in FIG. 3.
Figure 6:
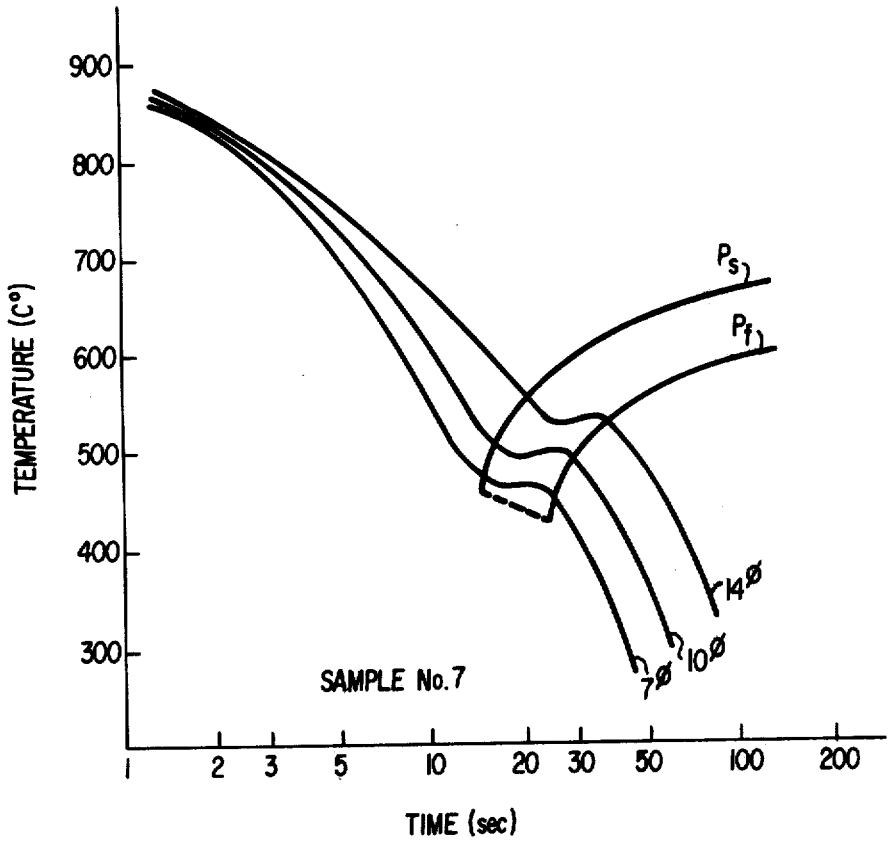
FIG. 6 is a plot showing a continuous cooling curve for sample 2 shown in FIG. 4.

FIGS. 5 and 6 show continuous cooling curves obtained according to the controlled cooling of Sample No. 4 (SP line) shown in FIG. 3 and Sample 2 (SM line) shown in FIG. 4. In either case, for rods having a diameter of over 9 mm, the phase transformation starts with a temperature approximately above the nose of the pearlitetransformation-starting line (Ps) of steel, terminating at a temperature corresponding to the pearlite transformation-terminating line (Pf). Those steel rods obtained present an extremely fine structure essentially consisting of fine particles, as compared with a steel rod obtained from the Sample No. 1.

The reason why the amount of carbon is limited to a range from 0.65 to 0.90% for a steel rod according to the present invention is that a carbon amount of less than 0.65% fails to achieve a desired high tensile strength from the controlled cooling treatment, even despite the addition of chromium, while carbon amounts higher than 0.90% results in noticeable precipitation of proeutectoid cementite, impairing the toughness of the steel rod and wire made therefrom. Thus, the preferable range of carbon should cover between 0.75 and 0.85%.

It should be noted that chromium plays an important role in the controlled cooling treatment for a high carbon steel rod having large gauge. As has been described earlier, by using chromium in a suitably increased amount, steel rods may be obtained which have high tensile strength, high ductility and toughness, which could not otherwise be obtained by conventional controlled cooling techniques, and which are drawable without the use of any re-heat treatment. The amount of chromium contained is adjusted depending on the desired mechanical properties and diameter of the steel rod. However, chromium amounts of over 0.15% are essential for achieving high tensile strengths, high ductility and toughness in the desired steel rods. A chromium amount of less than 0.15% will not yield tensile strengths as high as 115 kg/mm², even for a steel rod having a diameter of about 9 mm. With an increase in the amount of chromium, there may be expected an increase in tensile strength, ductility and toughness. Chromium amounts of over 15% will result in an increased scatter in quality, and potential inability to maintain the reduction of area to a level of over 35%. In this respect, a high carbon steel containing from 0.5 to 1.2% chromium is preferable for the SP line, according to the present invention. In other words, chromium amounts exceeding 1.2% exhibit indications of brittleness, while chromium amounts of less than 0.5% give lowered tensile strengths. On the other hand, a high carbon steel containing from 0.20 to 0.5% chromium is preferable for the SM line. Chromium amounts of less than 0.20% give lowered tensile strengths, while chromium amounts of over 0.5% exhibit an indication of brittleness.

Silicon is used as a deoxidizer in steel making and contributes to the improvements in tensile strength. However, silicon amounts of over 2.0% result in lowered ductility and toughness, and hence should be limited to below 2.0%.

Manganese contributes to improvements in strength and toughness. However, amounts of manganese exceeding 1.5% will excessively enhance the hardenability and produce a martensite structure, which in turn can impair drawability. Thus, the amount of manganese should be less than 1.5%.

For achieving fine austenitic grain sizes for steels of this kind, there may be used at least one of Al, Nb, V, Zr, and Ti, in amounts of 0.3% in total.

However, an amount of more than 0.3% will not afford any improvement in achieving a fine austenitic structure, but will impair the drawability, ductility and toughness.

Thus far, the emphasis has been particularly on steel rods having a diameter of 9 mm. However, the principle of the present invention may be applied to steel rods having a diameter on the order of 19 mm. The preferable tensile strength should be over 115 kg/mm², but the level of 120 kg/mm² is additionally desirable and attainable by this invention. The reduction of area should preferably be over 35% as far as presenting desirable drawability.

As has been described thus far, according to the present invention, there is provided a steel rod of a gauge of greater than 9 mm in diameter which is drawable without re-heat treatment and which exhibits tensile strength of over 115 kg/mm², and which is essentially of a fine pearlite structure, such as produced by a controlled cooling treatment after hot rolling. Thus, the present invention exceeds the technical limits of the conventional controlled cooling treatment.

Having generally described the invention, a more complete understanding can be obtained by reference to certain specific examples, which are included for purposes of illustration only and are not intended to be limiting unless otherwise specified.

EXAMPLE 1

High carbon steels having chemical compositions shown in Table 2 were subjected to hot rolling and controlled cooling under conditions shown in Table 3 in the SP line. Table 4 indicates the mechanical properties of the steel rods thus obtained.

TABLE 2

| Sample No. | Chemical Composition of Sample Steel Rod (%) | | | | | |
|---|---|---|---|---|---|---|
| | C | Si | Mn | Cr | Al | Ti |
| 8 | 0.82 | 0.24 | 0.81 | 0.08 | 0.052 | — |
| 9 | 0.78 | 0.25 | 0.78 | 0.72 | 0.063 | — |
| 10 | 0.77 | 0.95 | 1.05 | 0.25 | 0.045 | 0.05 |

TABLE 3

Hot Rolling and Adjusted Cooling Condition Versus Diameter of Steel Rod (SP line)

| diameter of rod (mm) | billet heating temp. (° C) | rolling rate m/sec | primary water cooling zone temp. (° C) | conveyor speed m/min | conveyor type * |
|---|---|---|---|---|---|
| 12 | 1160 | 26.0 | 800 | 31.7 | V + H |
| 10 | 1150 | 80.0 | 850 | 28.5 | V + H |
| 9.5 | 1140 | 80.0 | 800 | 28.5 | H |

*V : vertical conveyor
H : horizontal conveyor

TABLE 4

Mechanical Properties of Steel Rod of Large Gauge After Controlled Cooling

| Sample No. | Diameter of rod (mm) | Tensile Strength kg/mm² $\bar{x}$ | Tensile Strength kg/mm² Σ | Reduction of area $\bar{x}$ | Reduction of area Σ | Remarks |
|---|---|---|---|---|---|---|
| | 12 | 107.8 | 2.29 | 29.7 | 3.67 | |
| 8 | 10 | 106.8 | 2.65 | 30.6 | 2.95 | |
| | 9.5 | 106.6 | 1.91 | 26.0 | 3.39 | |
| | 12 | 118.4 | 1.99 | 45.3 | 3.23 | |
| 9 | 10 | 119.5 | 2.25 | 43.0 | 3.30 | present invention |
| | 9.5 | 123.4 | 2.50 | 40.0 | 3.25 | |
| 10 | 12 | 125.6 | 2.15 | 42.5 | 2.05 | |

The steel rod of Sample No. 9 and of a diameter of 12 mm, as shown in Table 4, which rod has been subjected to the controlled cooling treatment, were drawn to a diameter of 6 mm without re-heat treatment, following the pass schedule shown below:

12ϕ 10.7ϕ 9.6ϕ 8.6ϕ 7.6ϕ 6.7ϕ 6.0ϕ

(respective reduction of area about 20%, total reduction of area 75%). Then, the steel wires were subjected to a stress relieving treatment for 1 minute at a temperature of 350° C. Table 5 shows the results of measurements of mechanical properties of wires thus obtained and those subjected to the stress relieving treatment.

TABLE 5

Mechanical Properties of Steel Wires Drawn Which Have Been Subjected to Controlled Cooling and Those After Stress Relieving (Sample No. 9 6 mmϕ)

| | tensile strength kg/mm² $\bar{x}$ | Σ | reduction of area % $\bar{x}$ | Σ | elongation GL = 100 % | No. of torsions 100d | No. of reverse bends R = 2d |
|---|---|---|---|---|---|---|---|
| steel wires drawn | 172.2 | 2.22 | 53.2 | 1.22 | 4.0 | 43.5 | 15.9 |
| stress relieving | 178.3 | 1.82 | 48.0 | 2.18 | 5.8 | 24.3 | 12.2 |

EXAMPLE 2

High carbon steels having chemical compositions shown in Table 6 were subjected to hot rolling under the conditions given in Table 7 in the SM line, and then to the controlled cooling treatment. Table 8 shows the mechanical properties of steel rods thus obtained.

TABLE 6

Composition of Sample Steel Rod (%)

| Sample No. | C | Si | Mn | Cr | Al | Ti |
|---|---|---|---|---|---|---|
| 1 | 0.75 | 0.25 | 0.79 | 0.03 | 0.055 | — |
| 11 | 0.80 | 0.20 | 0.72 | 0.23 | 0.051 | — |
| 12 | 0.86 | 0.24 | 0.76 | 0.29 | 0.054 | — |
| 13 | 0.77 | 0.92 | 0.77 | 0.25 | 0.047 | 0.06 |

TABLE 7

Hot Rolling and Controlled Cooling Condition Versus Diameter of Steel Rod (SM line)

| Sample No. | diameter of rod (mm) | billet. heating of temp. (° C) | rolling rate m/sec | primary water cooling zone temp. (° C) | conveyor speed m/min | opening of air cooling valve above conveyor % |
|---|---|---|---|---|---|---|
| 1 | 12 | 1150 | 15.0 | 820 | 30.5 | 100 |
| 11 | 12 | 1140 | 16.0 | 840 | 33.0 | 100 |
| | 10 | 1150 | 25.0 | 880 | 39.0 | 100 |
| 12 | 12 | 1150 | 16.0 | 800 | 40.0 | 100 |
| | 10 | 1140 | 25.0 | 830 | 45.0 | 100 |
| 13 | 12 | 1100 | 15.1 | 850 | 38.0 | 100 |

TABLE 8

Mechanical Properties of Steel Rods of Large Gauge After Controlled Cooling Treatment

| Sample No. | Diameter of rod (mm) | Tensile strength kg/mm² $\bar{x}$ | Tensile strength kg/mm² σ | Reduction of area % $\bar{x}$ | Reduction of area % σ | Remarks |
|---|---|---|---|---|---|---|
| 1 | 12 | 108.1 | 1.58 | 36.8 | 1.65 | |
| 11 | 12 | 116.1 | 1.92 | 41.5 | 2.20 | |
| | 10 | 120.4 | 1.78 | 48.1 | 1.97 | present |
| 12 | 12 | 126.6 | 2.05 | 39.5 | 2.25 | invention |
| | 10 | 128.7 | 2.22 | 44.9 | 2.02 | |
| 13 | 12 | 122.3 | 1.95 | 41.5 | 2.15 | |

Steel rod of Sample No. 11 and having diameter of 12 mm and 10 mm, as shown in Table 8, which rods had been subjected to the controlled cooling treatment and were drawn to diameters of 5 and 6 mm, without re-heat treatment, following the pass schedules shown below:

12ϕ 10.7ϕ 9.6ϕ 8.6ϕ 7.6ϕ 6.7ϕ 6.0ϕ

(respective reduction of area — about 20%: total reduction of area — 75%)

10ϕ 8.6ϕ 7.6ϕ 6.7ϕ 6.0ϕ 5.5ϕ 5.0ϕ

Then, the steel rods drawn were subjected to a stress relieving treatment for one minute at a temperature of 350° C. Table 9 shows the mechanical properties of steel rods drawn and those subjected to stress relieving.

TABLE 9

Mechanical Properties of Drawn Steel Rods After Controlled Cooling and Those After Stress Relieving (Sample No. 11)

| Sample No. | | tensile strength kg/mm² | | reduction of area % | | elongation GL = 100 % | No. of torsions 100d | No. of reverse bends R = 2d |
|---|---|---|---|---|---|---|---|---|
| | | $\bar{x}$ | Σ | $\bar{x}$ | Σ | | | |
| 6 | Drawn steel rod | 176.6 | 2.87 | 51.7 | 1.79 | 3.7 | 37.8 | 16.8 |
| | Steel rod after stress relieving | 172.2 | 1.92 | 45.9 | 2.27 | 6.0 | 33.6 | 18.9 |
| 5 | Drawn steel rod | 181.2 | 2.50 | 54.7 | 1.88 | 3.2 | 39.3 | 18.5 |
| | Steel rod after stress relieving | 182.8 | 2.20 | 48.4 | 1.89 | 6.2 | 28.0 | 14.5 |

As is apparent from the foregoing description of the steel rod of a large diameter according to the present invention, a rod billet is hot rolled and subjected to the controlled cooling treatment to thereby give a steel rod which is essentially of fine pearlite structure and has a tensile strength of over 115 kg/mm². The steel rods thus obtained may be drawn without re-heating, and thus, the present invention oversteps the technical limits of the application of controlled cooling techniques on thick rods, giving great economic advantage to industry.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A method for producing a large gauge, high strength steel rod having a diameter of not less than 9 mm, which comprises subjecting a high carbon steel rod billet consisting essentially of from 0.65 to 0.9% C, from 0.15 to 1.5% chromium, less than 2.0% silicon, less than 1.5 manganese, at least one element from the group consisting of aluminum, niobium, vanadium zirconium and titanium in an amount of less than 0.3% in total, balance essentially iron, to hot rolling immediately followed by a controlled cooling treatment, by the use of an air cooling medium, so as to effect a phase transformation to obtain a structure consisting essentially of fine pearlite, whereby a steel rod having a tensile strength of above 115 kg/mm² is produced without any re-heating treatment, wherein the resulting steel rod has the mechanical properties such that it may subjected to a reduction in area is excess of 35% without requiring heat treatment.

* * * * *